US005572760A

United States Patent [19]

Patun

[11] Patent Number: 5,572,760

[45] Date of Patent: Nov. 12, 1996

[54] PORTABLE CLEANING AND SCRUBBING APPARATUS

[76] Inventor: Mark Patun, 316 Pearl, Owatonna, Minn. 55060

[21] Appl. No.: 418,597

[22] Filed: Apr. 6, 1995

[51] Int. Cl.[6] ..... B08B 3/06; A46B 11/00

[52] U.S. Cl. ..... 15/21.1; 134/138; 15/97.1

[58] Field of Search ..... 15/21.1, 39, 97.1; 134/138, 139

[56] References Cited

U.S. PATENT DOCUMENTS

| | | | |
|---|---|---|---|
| 1,574,452 | 2/1926 | South | 134/138 |
| 1,603,259 | 10/1926 | Mathewson . | |
| 2,573,794 | 11/1951 | Kueneman | 134/138 |
| 2,641,170 | 6/1953 | Hutchins | 95/93 |
| 2,721,556 | 10/1955 | Brucker | 134/101 |
| 2,722,941 | 11/1955 | Bartlett | 134/141 |
| 2,918,925 | 12/1959 | Dopler | 134/108 |
| 3,041,212 | 6/1962 | Booth | 134/138 |
| 3,580,261 | 5/1971 | Key . | |
| 4,132,235 | 2/1979 | Koplin et al. . | |
| 4,672,987 | 6/1987 | Brandt | 134/138 |
| 5,022,419 | 6/1991 | Thompson et al. . | |
| 5,067,193 | 11/1991 | Thomas . | |

*Primary Examiner*—David Scherbel
*Assistant Examiner*—Tony G. Soohoo
*Attorney, Agent, or Firm*—Jacobson & Johnson

[57] ABSTRACT

A cleaning apparatus with a rotatable frame in a housing. Objects to be cleaned are placed on the frame. A cleaning fluid is sprayed onto the objects to rotate the objects and frame. As the objects and frame rotate, the frame pushes against scrubbers which are thereby also rotated with the frame. Since the scrubbers themselves are mounted on a sum and planetary gear arrangement, the scrubbers spin against and thus clean the objects as they are being pushed by the rotating frame. Accordingly, the scrubbers are rotatable with the frame and rotatable relative to the frame. The scrubbers are still further slideable in the same direction relative to the rotatable frame to scrub each of the objects from end to end. Hence the objects are cleaned by spinning and sliding scrubbers as well as by the cleaning fluid being sprayed directly onto the objects. A method of cleaning objects or tools is also disclosed.

18 Claims, 2 Drawing Sheets

PORTABLE CLEANING AND SCRUBBING APPARATUS

BACKGROUND OF THE INVENTION

1. Field of the Invention

The present invention relates generally to cleaning apparatus, particularly to such apparatus having a rotating frame on which to be cleaned are mounted, and specifically to such rotatable apparatus which are rotatable by cleaning fluid being sprayed onto the objects and more specifically to such a rotatable cleaning apparatus having a scrubber assembly for scrubbing the objects.

2. Description of the Prior Art

The art of printing includes undesirable chores such as washing printing equipment. The chemicals used in the art are often rather sticky and viscous and thus difficult to remove from printing equipment. Two pieces of printing equipment from which such chemicals are to be removed are the squeegee and the flood bar, which is a scraper-like tool. The flood bar includes an elongate portion formed somewhat like a paddle. Both tools may have irregularly shaped portions such as protruding handles. Unfortunately, the nature of both the chemicals and the tools lend themselves only to hand washing, which is inefficient, messy, and dangerous to the health of the printing personnel.

SUMMARY

Accordingly, a general object of the invention is to provide a unique cleaning apparatus which efficiently cleans objects automatically.

Another object of the invention is to provide an automatic cleaning apparatus which uniquely rotates the apparatus by spraying cleaning fluid directly on the objects to be cleaned. Specifically, a frame is provided which is rotatably mounted relative to a housing. Objects to be cleaned are placed on the periphery of the rotatable frame and fluid is sprayed onto the objects which in turn drives the frame to rotate. As the frame rotates, rows of objects are brought repeatedly into the spray of the cleaning fluid.

Another object of the invention is to provide an automatic cleaning apparatus which uniquely scrubs the objects. Specifically, scrubbers are provided which rotate with the frame, spin against their respective objects, and slide in an axial direction on their respective objects.

Another object of the invention is to provide an automatic cleaning apparatus which is uniquely energy efficient. Thus the linear motion of the sprayed fluid imparts a rotary motion to the objects, frame, and scrubbers. The rotary motion in turn imparts a spinning motion to the scrubbers themselves. A fluid driven cylinder efficiently provides multiple functions of sliding the scrubbers against the objects to clean the objects, opening and closing the lid of the drum like housing, and sliding the frame into and out of the housing for loading and unloading objects from the frame.

Another object of the invention is to provide an automatic cleaning apparatus which uniquely thoroughly cleans objects. Hence both spraying and scrubbing are provided by the invention. Further, counter spray nozzles are provided on the housing to spray the cleaning fluid onto both sides of the objects. Still further, the scrubbers both spin and slide against the object from end to end. Further yet, adjacent scrubbers spin in opposite directions.

Another object of the invention is to provide an automatic cleaning apparatus which uniquely dries the objects after cleaning. Specifically, the manifold for directing the cleaning fluid onto the objects also introduces air for drying the objects into the housing.

Another object of the invention is to provide a unique method for cleaning objects with scrubbers.

Another object of the invention is to provide an automatic cleaning apparatus which is uniquely simple and inexpensive to manufacture, operate, maintain and repair.

These and further objects and advantages of the present invention will become clearer in light of the following detailed description of the illustrative embodiment of this invention described in connection with the drawings.

Figure 1:
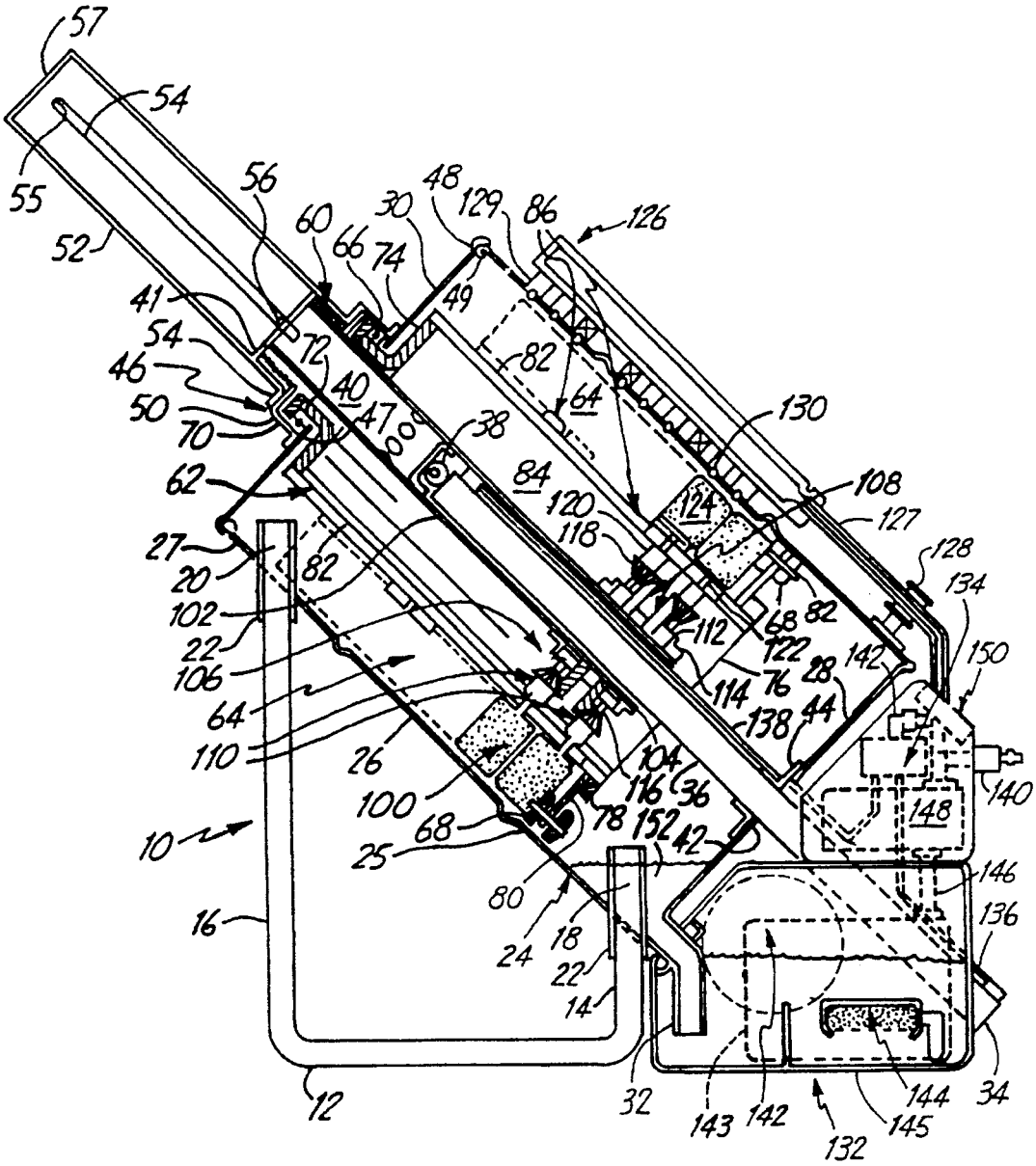
FIG. 1 shows a side, partially section, partially diagrammatic view of the preferred embodiment of the present cleaning apparatus.
Figure 2:
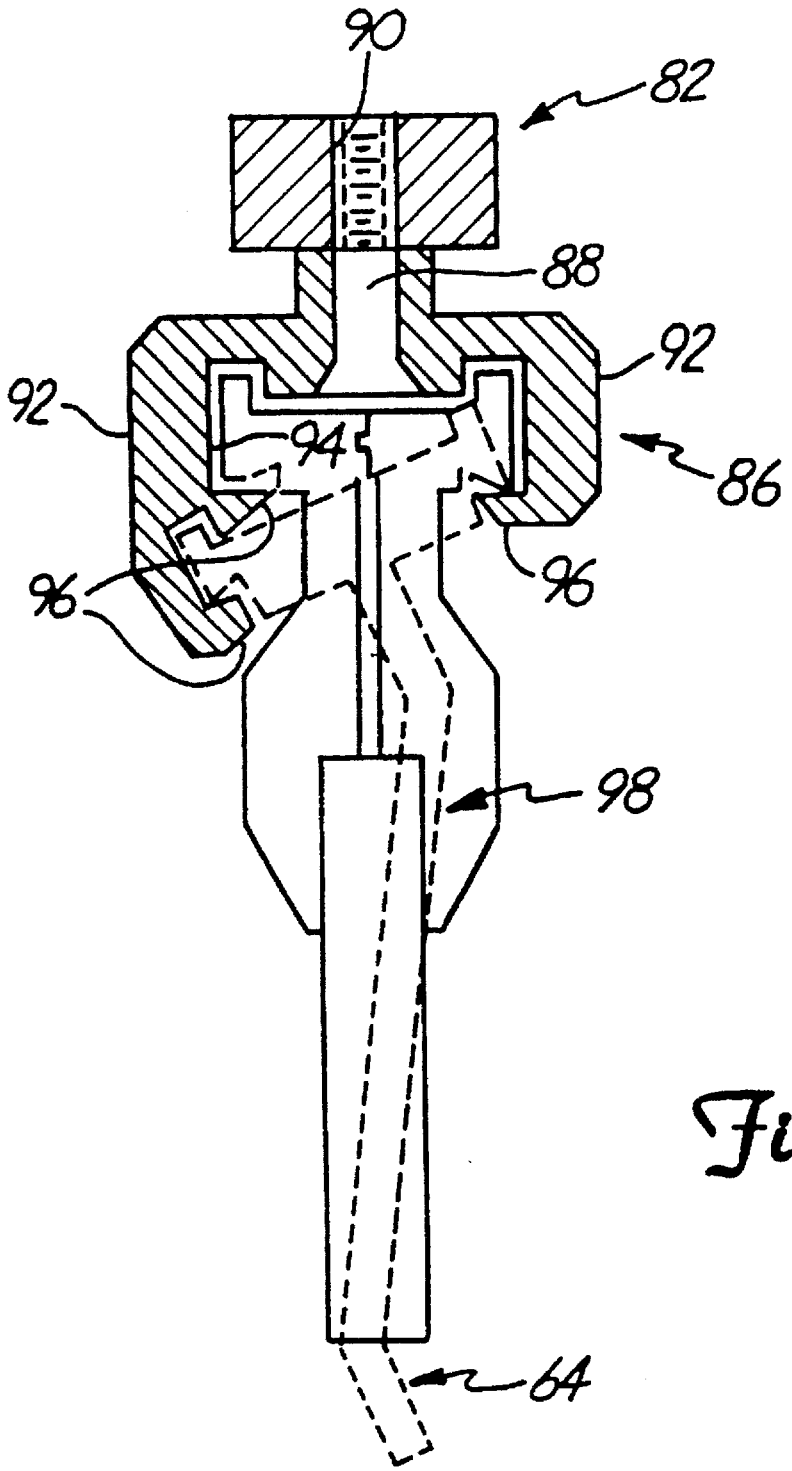
FIG. 2 shows an isolated partially section view of objects to be cleaned by the apparatus of FIG. 1 and shows the locking arrangement between the objects and the rotating frame of such cleaning apparatus.

All Figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "axial", "end", "peripheral", "radial", "upper", "lower", "first", "second", and similar terms are used herein, it should be understood that these terms have reference only to the structure shown in the drawings as it would appear to a person viewing the drawings and are utilized only to facilitate describing the preferred embodiment.

DETAILED DESCRIPTION

As shown in FIG. 1, the preferred embodiment of the cleaning apparatus is indicated in general by the reference numeral 10. The cleaning apparatus 10 includes a base 12 with a lower drum supporting end 14 and an upper drum supporting end 16. The ends 14, 16 include respective circular or semi-circular integral portions 18, 20 having padding 22 mounted thereupon for isolating the base 12 from a housing 24 and any vibrations produced therein. The base 12 mounts the housing 24 at generally a 45° angle relative to a floor to provide a completely self-draining housing 24.

The housing 24 typically includes a 50 gallon drum 25. The drum 25 includes a cylindrical sidewall 26 with a disc like bottom 28 rigidly fixed such as welding to the sidewall 26 and a disc like top or lid 30 removably and sealingly fixed relative to the sidewall 26. The drum 25 further includes a self-draining outlet pipe 32 fixed between the bottom 28 and the sidewall 26 at a lowermost portion of the housing 24 to permit fluid to drain by gravity from the housing 24.

The housing 24 further includes a fluid driven cylinder 34 rigidly fixed to the drum bottom 28 and extending through both the drum bottom 28 and drum lid 30. The cylinder 34 includes a piston chamber 36, a shaft head 38 of a piston shaft linearly slideable in the piston chamber 36, and a ram 40 fixed on the shaft head 38 and thus also linearly slideable to and away from the piston chamber 36. The ram 40 includes a disc like head 41. The piston chamber 36 extends through an opening 42 formed in the disc like bottom 28 and may be rigidly fixed to the bottom 28 by an annular extending angle iron brace 44 which may be welded both to the piston chamber 36 and to the bottom 28 to aid in supporting the cylinder 34.

The housing 24 further includes a closure arrangement 46. The closure arrangement 46 includes the drum lid 30, an inner circular edge 47 of the drum lid 30 and an outer circular flanged edge 48 of the drum lid 30. A slotted annular sealing strip 49 on the upper edge 27 of the sidewall 26 is sandwiched between the flanged edge 48 and the upper edge 27 for sealing the drum lid 30 relative to the sidewall 26 against fluid leakage. The closure arrangement further includes a collar 50 adjacent the inner annular edge 47 and surrounding the ram 40. The collar 50 is rigidly affixed, such as by welding, to the drum lid 30. The closure arrangement 46 still further includes a receptor 52 for the receiving and guiding the ram 40. The receptor 52 is cylindrical and includes an annular lip 54 which is rigidly affixed, such as by welding, to the collar 50. The receptor 52 includes an inner diameter slightly larger than or equal to the diameter of the ram head 41 such that the ram 40 is slidingly supported by the receptor 52. The receptor 52 further includes a pair of tracks 54 formed in the axial direction and including an upper edge or stop 55. The tracks 54 receive and guide opposite ends of a pin 56 mounted on the head 41 of the ram 40 such that the pin 56 and tracks 54 guide the ram 40 as the ram 40 slides to and away from the piston chamber 36. The stop 55 of each of the tracks 54 abuts the pin 56 and functions to stop relative sliding movement of the ram 40 and receptor 52. The receptor 52 still further includes a disc like top 57 rigidly fixed thereto. The length of the receptor 52 is about one-half the length of the piston chamber 36.

The closure arrangement 46 still further includes clamping coil spring 60 mounted in the receptor 52 between the collar 50 and the head 41 of the ram 40. The spring 60 is compressed into its fully compressed state by the head 41 of the ram 40 as shown in FIG. 1. The coil spring 60 is further in a compressed state, albeit less compressed state, when the pin 56 engages the stop 55 such that the drum lid 30 remains sealed against the sidewall 26. In both such fully compressed and less compressed states, the spring 60 brings pressure to bear on the collar 50 and thus on the lid 30 to urge the flanged edge 48 against seal 49 and upper edge 27 of the sidewall 26.

A frame or carrousel or rotating cage carrier 62 for engaging flood bar objects 64 is rotatable in the housing 24. The frame 62 is supported in the housing via a bearing 66 and rollers 68. The bearing 66 includes an outer annular race 70 rigidly affixed to an inner surface of the collar 50 and an upper surface of the inner edge 47. The bearing 66 further includes an inner annular race 72 rigidly affixed to an upper annular end 74 of the frame 62. The annular end 74 extends on either side of the drum lid 30. A lower end 76 of the frame 62 includes an annular support bar 78 and an annular and radially extending plate 80 rigidly fixed to the bar 78. The rollers 68 include axles engaged by the plate 80. The rollers 68, of which there are a plurality mounted about the periphery of the plate 80, ride against the inner surface of the sidewall 26 when the frame 62 is rotated. One roller 68 is mounted on each of the ends of one axle.

The frame 62 further includes a plurality of bars 82 extend between and are rigidly connected to the annular bar 78 and upper end 74 to form a cage or rack portion or open bar structure 84 of a cylindrical shape. The bars 82 are parallel to and spaced from each other. The bottom end 76 of the frame 62 is open. The upper end 74 includes an opening for the ram 40. The cage portion 84 is of a smaller diametric size than the sidewall 26 of the drum 25 so as to permit the mounting of the flood bar objects 64 on the bars 82 and between the bars 82 and the sidewall 26.

The flood bar objects 64 are engaged to the bars 82 via clamp like locking tabs 86. Each of the locking tabs 86 is mounted on one of the bars 82 by a pin connector 88 threaded in a hole 90 formed in the bar 82. Each of the tabs 86 is somewhat elongate and mounted in line with its respective bar 82. Each of the tabs 86 has opposing resilient sides 92 which are integral with each other. The tab sides 92 form an interior surface 94 tailored to fit the object to be cleaned and engaged to the frame 62. Typically, each of the sides 92 includes integral resilient lips 96 extending inwardly to lock the object engaged therein. An example of another object that may be engaged with the locking tabs 86 is a squeegee object 98.

A scrubber or brush drive assembly 100 includes a cylindrical mount 102 rigidly affixed to the ram 40. The mount 102 extends over and is spaced from the piston chamber 36 and includes a lower open end 104. Adjacent the open end 104 is mounted a gear assembly 106. The gear assembly 106 includes a pair of annular stationary sun bevel gears 108. One of the gears 108 faces the lower end 76 of the frame 62 and the other gear 108 faces the upper end 74 of the frame 62. Two sets of counter rotating planetary bevel gears 110 engage their respective sun bevel gears 108. Each of the sets includes a plurality of planetary gears 110. Each of the planetary gears 110 includes a base portion 112 formed of a bushing or bearing to slide annularly about the cylindrical mount 102 in a spider 114, a shaft 116 extending form and pivotally mounted in the base portion 112 such that the shaft 116 spins relative to the base portion 112, a bevel gear head portion 118 on the shaft 116, a spacer 120 mounted on the bevel gear head portion 118 for spacing the head portion 118 from the base 82, an extension 122 extending from the spacer 120 through adjacent bars 82, and a cylindrical scrubber 124 mounted on the extension 122. Bearings or bushings, if desired, may be disposed between the extension 122 and its adjacent bars 82 to permit an efficient sliding action of the extension 122 between the bars 82 in an axial direction. In its preferred form, the scrubbers 124 are brushes, but may also includes scrubbers 124 which are formed from rubber or foam rubber like materials. The length of the scrubber 124 is sufficient to extend at least over the width of the object 64. The width of the scrubber 124 is sufficient to engage a pair of objects mounted on adjacent, parallel bars 82 such that each of the objects 64 is scrubbed on its opposite sides by different scrubbers 124.

A nozzle manifold or spray means 126 is fixed to the sidewall 26 of the housing 24 for spraying fluid such as cleaning liquid or air for drying into the drum 25. The manifold 126 includes an inlet pipe 127 fixed relative to the housing via an arm 128. The manifold 126 includes nozzles 129 extending through the sidewall 26. Each of the nozzles 129 includes an outlet 130. The nozzles 129 extend from one end to the other end of the object 64. The nozzles 129 direct fluid generally at intermediate portions of the objects so as to spread the cleaning fluid over as much of the surface of the object as possible. Typically, more than half of the nozzles 129 are oriented the direction of rotation to impart a rotating force to the frame 62. The remaining nozzles 129 are directed in the opposite direction for a counter spray such that fluid impinges on both sides of the objects 64.

An operating system 132 includes a pneumatic valve control 134 with a feed line 136 extending therefrom to one end of the cylinder 34 for extension of the ram 40 and with a feed line 138 for retraction of the ram 40. The feed line 138 sealingly extends through an opening formed in the annular brace 44. The pneumatic valve control 134 includes an inlet 140 which communicates with the feed lines 136 and 138. Piping 142 between the pneumatic valve control 134 and manifold inlet 127 permits air to be pumped into the manifold 126 and the drum 25.

The operating system 132 further includes a motor 142 and high pressure pump 143 with a filter 144 for pumping and recycling cleaning fluid being drained via outlet 32 from the drum 25. The outlet 32 extends into a housing 145 in which are mounted the motor 142, pump 143, and filter 144. The pump 143 conveys fluid through piping 146 to a fluid valve control 148 and subsequently to the inlet 127. The pump 143 is a sludge pump to remove ink and debris and to recycle mineral spirits. The pump 143 and two horse power motor 142 deliver about three and one-half to four gallons per minute to the nozzles 129. Such may provide about 11 pounds of driving force to initiate the rotation of the frame 62 and planetary gears 110.

A control panel 150 may be electrically connected to the valve controls 134 and 148 and may, for example, control extension and retraction of the ram 40, turn the motor 142 and pump 143 on and off to control cleaning fluid being sprayed from the nozzles 129, turn off the motor 142 and pump 143 and close the valve in valve control 148 and open the pneumatic valve in valve control 142 to permit jets of air to be directed into the drum 25 to dry the objects 64. It should be noted that an air compressor may be connected to the barbed inlet 140. Cleaning fluid in the drum 25 is designated by reference numeral 152. Now that the construction of the cleaning apparatus 10 according to the teachings of the preferred embodiment of the present invention has been set forth, subtle features and advantages of the preferred construction of the present invention can be appreciated. The frame 62 is fully extendible out of the drum 25 such that the frame 62 is easily loaded with objects 64 to be cleaned. To extend the frame 62 out of the drum 25, the ram 40 is extended, for example, from the fully retracted position shown in FIG. 1. As the ram 40 begins to extend, the spider 114 begins to move in the axial direction, carrying with it the scrubbers 124 which slid in the axial direction between the bars 82 and the sidewall 26. As the ram 40 is extended from such a position, the pin 56 rides in track 54 and subsequently engages the upper edge 55 of the track 54. During such extension, the spring 60 remains in a compressed state, albeit less compressed state. As the ram 40 is further extended, the pin 56 brings pressure to bear on the upper edge 55 thereby lifting the lid 30 off of the sidewall 26 and the frame 62 and scrubbers 124 out the drum 25. When the pin 56 is engaged with the upper edge 55, the scrubbers 124 are located adjacent the upper end 74 of the frame 62. The piston shaft in the piston chamber 36 is generally twice the length of the frame 62 such that the frame 62 is slid almost completely out of the drum 25 and such that the cage portion 84 and the locking tabs 86 are readily accessible for the engagement and disengagement of objects such as the flood bar objects 64. The diameter defined by the rollers 68 is slightly less than the inside diameter of the sidewall 26 such that as the frame 62 is slid out of the drum 25, the rollers 68 also readily slide transversely out of the frame 62.

When the frame 62 is located out of the drum 25, the cage portion 84 is loaded or unloaded with objects 64. The flood bar objects 64, which are elongate, are clipped or locked into the tabs 82 to extend in the axial direction. The objects 64 are also engaged between the bars 82 and the sidewall 26 to extend in the radial direction. Typically, the frame 62 includes about 15 bars arranged cylindrically to mount 15 flood bar objects 64 or 15 squeegee objects 98.

After the frame 62 is loaded with objects, the cylinder 34 is operated to retract the ram 40 and slide the frame 62 back into the drum 25. Upon initial retraction of the ram 40, the spring 60 is compressed slightly, if any. Compression of the spring 60 is generally initiated after the frame 62 has slid completely into the drum 25, when the lid 30 engages the sidewall 26. It is generally at this point that the scrubbers 124 begin to move away from the upper end 74 of the frame 62 and toward the lower end 104. It is further generally at this point that spraying may be initiated, as the lid 30 is sealingly engaged with the drum 25.

Spraying of cleaning fluid 152 into the drum 25 is started by operating the motor 142 and pump 143 and by opening the valve in the valve unit 148. As the cleaning fluid 152 is sprayed against the objects 64, such a spraying linear force is transmitted through the locking tabs 82 and to the bars 82 to impart rotation to the frame 62. Initially, it may be desired to close some of the counterflow outlets 130 to permit the frame 62 to gain inertia and rotate more quickly whereupon the counterflow outlets may be opened to spray the opposite sides of the objects 64. Such a function may be provided by electrically controlling valves in nozzles 129.

As the cleaning fluid 152 is sprayed against the objects 64 and as such force is transmitted to the bars 82, the bars 82 in turn push against the extension 122 of the scrubbers 124 and thereby push the planetary gears 110 about the annular extending sun gears 108. As the planetary gears 110 engage the sun gears 108 and thereby rotate, the scrubbers 124 spin on an axis radially extending from the cylinder 34 to wash and scrub their respective objects located on parallel adjacent bars 82.

As the frame 62 rotates and the scrubbers 124 spin, the ram 40 may be extended and retracted between the frame ends 74 and 76 to slide the scrubbers 124 between the ends of the objects 64. Accordingly, through the sliding action, generally all surface areas of the objects 64 are scrubbed by the scrubbers 124. The adjacent scrubbers 124 rotate in opposite directions by virtue of the grooved faces of the respective sun gears 108 facing away from each other.

The extension and/or retraction of the ram 40 may be ceased to permit a washing of the objects 64 without the objects being scrubbed from end to end. The objects may be scrubbed without fluid being introduced into the housing 24 and without rotation of the frame 62.

The cleaning fluid 152 is recycled. The fluid 152 drains out of outlet 32 and into the housing 145. From the housing 145, the fluid 152 is pumped back into the manifold 126 and into the drum 25.

A valve in fluid valve unit 148 may be closed to cut off the flow of cleaning fluid into the drum 25. At such time, a valve in valve unit 134 may be opened, and an air compressor connected to inlet 140 may pump air into the drum 25 to dry the objects 64 or at least eliminate excess cleaning fluid from the objects.

A unique method for cleaning the objects include the steps of spraying the objects with a cleaning fluid such as water or a water or organic solvent based cleaning fluid, rotating the objects about a first axis, rotating the scrubbers about the first axis, spinning the scrubbers about a second axis different from the first axis, sliding the scrubbers along the first axis, engaging the scrubbers with the objects during the steps of rotating the objects, rotating the scrubbers, spinning the scrubbers, and sliding the scrubbers, and finally directing jets of air onto the objects for drying the objects or removing excess cleaning fluid from the objects. The steps preferably occur simultaneously. If desired, the steps may occur sequentially or in any desired order.

The apparatus 10 helps to reduce labor costs, minimize chemical contamination, increase productivity and the availability of tools such as squeegee and flood bars.

The cleaning cycle of spraying the objects with cleaning fluid, scrubbing the objects, and drying the objects with jets of air, may be as short as about 60 seconds. The spraying of the cleaning fluid may be accomplished at about 800 psi.

The open bar structure or cage portion 84 permits a spraying or washing therethrough and throughout the drum 25.

If desired a motor could be mounted on lid 30 to drive the carrousel at a greater speed.

What is claimed is:

1. A cleaning apparatus for cleaning objects comprising:

(a) a housing having a first axis;

(b) first spray means engaged with the housing for directing a cleaning fluid into the housing and onto the objects to be cleaned;

(c) a rotatable frame mounted in the housing engaging the objects for rotation about the first axis, the rotatable frame being rotatable about the first axis by the cleaning fluid being directed against the objects; and (d) a scrubber drive assembly in the housing for scrubbing the objects, the scrubber drive assembly having at least one scrubber.

2. The cleaning apparatus of claim 1 wherein the scrubber drive assembly and frame are relatively slideable as to each other in an axial direction such that the objects are scrubbed in the axial direction.

3. The cleaning apparatus of claim 1 wherein the scrubber drive assembly includes scrubber rotation means for rotating the scrubber about the first axis with the frame.

4. The cleaning apparatus of claim 1 wherein the scrubber drive assembly is slideable out of the housing.

5. The cleaning apparatus of claim 1 further comprising second spray means for spraying the objects from a direction counter to a direction of spraying of the first spray means.

6. The cleaning apparatus of claim 1 wherein the housing includes an outlet, and further comprising means for recycling the cleaning fluid from the outlet to the spray means.

7. The cleaning apparatus of claim 1 wherein the scrubber drive assembly includes scrubber spin means for rotating the scrubber on a second axis different from the first axis such that the scrubber is rotatable relative to the frame.

8. The cleaning apparatus of claim 7 wherein the second axis extends radially from the first axis.

9. The cleaning apparatus of claim 4 wherein the scrubber drive assembly includes at least two adjacent scrubbers which rotate in opposite directions.

10. The cleaning apparatus of claim 7 wherein the scrubber spin means includes a gear arrangement extending from the first axis and mounted between the first axis and the frame.

11. The cleaning apparatus of claim 10 wherein the gear arrangement comprises a sun gear extending annularly about the first axis and being fixed relative to the first axis and a planetary gear fixed relative to the scrubber and engaging the sun gear for rotating the scrubber.

12. The cleaning apparatus of claim 1 further comprising means for sliding the frame out of the housing whereby the frame is readily accessible for loading and unloading objects.

13. The cleaning apparatus of claim 12 wherein the sliding means includes means for opening and closing the housing as the frame slides into and out of the housing.

14. A cleaning apparatus for cleaning objects comprising:

(a) a housing having a first axis, the housing includes a cylindrical sidewall and the frame includes a periphery, with the objects being disposed between the sidewall and the periphery of the frame (b) first spray means engaged with the housing for directing a cleaning fluid into the housing and onto the objects to be cleaned; and (c) a rotatable frame mounted in the housing engaging the objects for rotation about the first axis, the rotatable frame being rotatable about the first axis by the cleaning fluid being directed against the objects.

15. The cleaning apparatus of claim 14 further comprising means for introducing pressurized streams of air into the housing for drying the objects.

16. A cleaning apparatus for cleaning objects comprising:

(a) a housing having a first axis;

(b) a rotatable frame mounted in the housing engaging the objects for rotation about the first axis, and being rotatable about the first axis; and (c) a scrubber drive assembly in the housing for scrubbing the objects, the scrubber drive assembly having at least one scrubber, the scrubber drive assembly comprising:

(i) scrubber rotation means for rotating the scrubber about the first axis with the frame;

(ii) scrubber spin means for rotating the scrubber on a second axis different from the first axis such that the scrubber is rotatable relative to the frame; and (iii) means for moving the scrubber assembly in an axial direction relative to the rotatable frame whereby the objects are scrubbed from end to end with a spinning scrubber.

17. The cleaning apparatus of claim 16 further comprising cleaning fluid in the housing.

18. The cleaning apparatus of claim 17 further comprising means on the housing for spraying the cleaning fluid therein upon the objects to impart rotation to the frame.

* * * * *